US006620211B2

(12) United States Patent
Veugelers et al.

(10) Patent No.: US 6,620,211 B2
(45) Date of Patent: Sep. 16, 2003

(54) METHOD FOR DYEING TEXTILE MATERIALS IN A SUPERCRITICAL FLUID

(75) Inventors: Wilhelmus J. T. Veugelers, Kessel (NL); Geert Feye Woerlee, Amsterdam (NL); Hendrik Gooijer, Amsterdam (NL); Jan Willem Gerritsen, Wijchen (NL)

(73) Assignee: Stork Prints B.V., Boxmeer ( * ) Notice: Subject to any disclaimer, the term of this patent is extended or adjusted under 35 U.S.C. 154(b) by 92 days.

(21) Appl. No.: 09/781,519

(22) Filed: Feb. 9, 2001

(65) Prior Publication Data

US 2001/0020311 A1 Sep. 13, 2001

(30) Foreign Application Priority Data

Feb. 16, 2000 (NL) ..... 1014395

(51) Int. Cl.[7] ..... D06P 1/94; D06P 1/38; D06P 1/16

(52) U.S. Cl. ..... 8/475; 8/529; 8/543; 8/917; 8/918

(58) Field of Search ..... 8/543, 475, 917, 8/918, 529

(56) References Cited

U.S. PATENT DOCUMENTS

| | | | | |
|---|---|---|---|---|
| 5,578,088 | A | | 11/1996 | Schrell et al. |
| 5,972,045 | A | * | 10/1999 | Eggers et al. |
| 6,010,542 | A | * | 1/2000 | DeYoung et al. |

FOREIGN PATENT DOCUMENTS

| | | | |
|---|---|---|---|
| DE | 39 06 724 | A1 | 9/1990 |
| DE | 43 32 219 | A1 | 3/1994 |
| DE | 44 04 839 | A1 | 8/1995 |
| DE | 44 22 707 | A1 | 1/1996 |
| EP | 0222207 | B1 | 5/1987 |
| EP | 0 690166 | A2 | 1/1996 |
| WO | WO94/18264 | | 8/1994 |
| WO | WO97/17143 | | 5/1997 |

OTHER PUBLICATIONS

Beltram et al. "Dyeing of Cotton in Supercritical Carbon Dioxide", *Dyes and Pigments*, vol. 39, No. 4, pp. 335–340, 1998 Great Britain.

Giehl et al. "Wolle Färben Ohne Wasser Möglichkeiten Und Grenzen Überkritischer Fluide", DWI Reports 112, pp. 456–465, (1999).

Geissmann et al. Farben aus uberkritischem CO2 von Wolle und Polyester/Woole–Mischunger, pp 12–19, Lextilvened-lung Nov. 12, 1999.*

Bobeth et al. "Textile Faserstoffe", bescheffenheit Und Eigenschaften, pp 231–255, Springer–Verlag, Jan., 1993.*

* cited by examiner

*Primary Examiner*—Margaret Einsmann
(74) *Attorney, Agent, or Firm*—Hoffmann & Baron, LLP

(57) ABSTRACT

In a method for dyeing textile material with one or more fiber-reactive disperse dyestuffs in a supercritical or almost critical fluid, such as $CO_2$, which textile material is selected from the group consisting of silk, wool and cellulose, combinations thereof and combinations of one or more thereof with synthetic fibers, such as polyester and/or polyamide, the relative humidity of the fluid is in the range from 10–100% during dyeing. Textile materials which have been dyed with the aid of this method have properties which are at least equal to those of textile materials of the same type which have been dyed in the traditional manner using water-soluble dyestuffs. A device for carrying out the dyeing method is also disclosed.

18 Claims, No Drawings

METHOD FOR DYEING TEXTILE MATERIALS IN A SUPERCRITICAL FLUID

FIELD OF THE INVENTION

The present invention relates to a method for dyeing textile material with one or more fibre-reactive disperse dyestuffs in a supercritical or almost critical fluid, which textile material is selected from the group consisting of silk, wool and cellulose, combinations thereof and combinations of one or more thereof with synthetic fibres.

BACKGROUND OF THE INVENTION

A dyeing method of this type for dyeing wool and wool-containing fabrics is known from the article "Wolle f ärben ohne Wasser. Möglichkeiten und Grenzen überkritischer Fluide" in DWI Reports 122 (1999). In this article, it is stated that modification of supercritical carbon dioxide with water, although increasing the solubility of a conventional wool dyestuff in the supercritical fluid and considerably increasing the dyeing, causes damage to the fibres at dyeing temperatures of over 100° C. An increase in the temperature is desirable in order to raise the dyeing rate. Fibre-reactive disperse dyestuffs are not subject to the problem of a (too) low solubility. It is reported that the most important advantage of fibre-reactive disperse dyestuffs is that the washfastness and fastness to rubbing are good.

The dyeing of textile materials in a supercritical fluid per se is already known from DE-A1-39 06 724. In this known method according to DE-A1-39 06 724, a supercritical fluid which contains one or more dyestuffs is made to flow onto and through a textile substrate which is to be treated. The type of fluid is in this case selected as a function of the dyeing system, which system is determined by the type of dyestuff and the type of textile material. Optionally modified polar (dipolar) supercritical fluids or mixtures thereof are selected for polar dyeing systems, such as water-soluble reactive dyestuffs, acid dyestuffs and basic dyestuffs. One example of a modifying agent for changing the polarity of supercritical $CO_2$ is water, so that the dyestuff used dissolves better in the supercritical fluid. Nonpolar fluids are used for nonpolar dyeing systems, such as disperse dyestuff systems. For textile materials which contain both nonpolar and polar fibres and are therefore dyed using different types of dyestuffs, it is proposed in DE-A-39 06 724 for these materials to be dyed in a plurality of steps, each step using a system of dyestuff and supercritical fluid which is suitable for one type of fibre. $CO_2$ as nonpolar supercritical fluid gives good results for dyeing textile materials made from the synthetic fibres of polyester and acetate using disperse dyestuffs, as is also described DE-A1-43 32 219. It is assumed that carbon dioxide dissolves in hydrophobic fibres of the textile material, such as the abovementioned polyester and acetate fibres, with the result that these fibres swell (cf. EP-B1-0 222 207, in which this effect is described), so that the uptake of the disperse dyestuff is improved. However, the above technique cannot readily be used for hydrophilic fibres, such as wool, silk and cellulose (cotton, viscose) fibres, with the conventional water-soluble acid or reactive dyestuffs or with disperse dyestuffs. To make it possible to dye textile materials which contain wool, silk or cellulose, if desired in combination with synthetic fibres such as polyamide fibres or polyester fibres, for this purpose it is proposed in the abovementioned DE-A1-43 32 219 for the textile materials to be pretreated with a hydrophobic finishing agent ("Ausrüstmittel") prior to the dyeing in supercritical $CO_2$ with a disperse dyestuff. This pretreatment can be carried out as a separate step by bringing the textile material Into contact with an aqueous solution of the finishing agent, if desired with heating, after which the pretreated textile material is thoroughly pressed and dried under conditions which are such that the hydrophobic finishing agent cures or crosslinks with the fibre. The pretreatment with the finishing agent may also be carried out directly in an autoclave in an atmosphere of supercritical $CO_2$. However, the washfastness and fastness to rubbing of textile materials which have been pretreated in this way and dyed are lower than the fastnesses which are required and can be achieved with the conventional acid or reactive dyestuffs which have been dissolved in water. This shortcoming is described in DE-A1-44 22 707. Incidentally, it is pointed out here that acid and alkaline dyestuffs do not form a covalent bond, but rather a much weaker ionic bond. When textile which has been dyed with dyestuffs of this type is rinsed or washed, contamination is released on account of the poor fixation of the dyestuffs to the textile. According to the dyeing method which is described in this latter application, for dyeing cellulose-containing substrates with fibre-reactive disperse dyestuffs in supercritical $CO_2$, the substrate is previously modified with compounds which contain amino groups, with the result that even and colourfast colours with good washfastness and fastness to rubbing are obtained. The fibre-reactive disperse dyestuffs used are dyestuffs which in addition to the fibre-reactive group do not contain any group which makes them soluble in water, and the fibre-reactive group itself is not or does not comprise a group which makes the dyestuff soluble in water. The term "fibre-reactive" in general refers to those molecule parts which can react and form a covalent bond with hydroxyl groups, for example of cellulose, or with amino and thiol groups, for example of wool and silk, of synthetic polymers, such as polyamides, and with amine-treated cellulose. The dyestuff therefore reacts with the fibres, so that a covalent bond is formed between the dyestuff and the fibre. A fibre-reactive disperse dyestuff of this type can be well fixed in cellulose and polyester materials on the basis of the chemical structure. However, the fixation of the dyestuff in polyester material is based on the penetration of the dyestuff into swollen polyester fibres, the dyestuff being mechanically "anchored" in the fibre when the swelling is eliminated at the end of the dyeing process. In the method described in the examples of DE-A1-44 22 707, a cotton-containing fabric is pretreated in accordance with a procedure which is known from EP-A1-0 546 476 and is then dried, after which the supercritical dyeing is carried out in an autoclave in which a dyestuff and a quantity of solid $CO_2$ are placed.

Currently, an increasing number of textile materials are being demanded and developed which are composed of different materials, for example purely of natural fibre materials, such as 80% cotton with the addition of 20% silk or wool, or combinations of natural fibre materials of this type with synthetic fibre materials, such as polyester and polyamide.

It has therefore been found that there is still a need for improvements and/or simplifications to the methods for dyeing textile materials in a supercritical fluid, in particular for combined textile materials which contain natural fibres, in particular based on cellulose (cotton, viscose).

It is an object of the present invention to provide a relatively simple and inexpensive method for dyeing a wide range of materials which contain at least one of the textile materials cellulose, wool or silk using one or more fibre-reactive disperse dyestuffs, resulting in colourfastnesses and washfastnesses which are comparable to or better than those achieved with reactive dyestuffs which are normally used for dyeing in water.

SUMMARY OF THE INVENTION

According to the invention, to this end the method of the type described in the introductory part is characterized in that the relative humidity of the fluid is in the range from 10–100% during dyeing.

The term supercritical fluid is understood as meaning a fluid in which the pressure and/or the temperature is/are above the critical pressure and/or critical temperature which is/are characteristic of the fluid in question. Examples of supercritical fluids which can possibly be used include, inter alia, $CO_2$, $N_2O$, the lower alkanes, such as ethane and propane, and mixtures thereof. In practice, the explosion limits and toxicity values also play an important role in the composition of the fluid.

The dyeing method according to the present invention is carried out under supercritical or almost critical conditions. This is contrary to WO 97/1743, wherein a continuous process for the application of textile treatment compositions to textile materials is disclosed. Therein the textile treatment composition such as a dipolar water soluble CI dye is dissolved in a supercritical fluid, however the application itself occurs under atmospheric conditions.

When carrying out the method according to the invention, it is ensured that a quantity of water is present and remains in the supercritical fluid, so that the relative humidity of the fluid lies between 10% and 100%, 100% representing the maximum molecular solubility of water in the supercritical fluid. If the relative humidity of the fluid is below 10%, the natural textile materials are too dry, and consequently the uptake of the dyestuff leaves something to be desired. It has even been found that dry $CO_2$ is capable of extracting some of the moisture which is naturally present in the textile materials, making the fibres less accessible to the dyestuff so that they are not dyed or are only slightly dyed. These natural, normal moisture contents for the various textile materials, based on the dry textile substrate, are approximately:

| | |
|---|---|
| wool | 14.5% by weight |
| cotton | 11.0% by weight |
| viscose | 13.5% by weight |
| silk | 10.5% by weight |
| polyester | 0.5% by weight |
| polyamide | 4.0% by weight. |

These moisture contents are based on the weight of the dry textile material in accordance with the following equation:

$$(\%) = \frac{m_v - m_d}{m_d} 100\%,$$

where $m_v$ is the mass of the textile material in the moist or wet state and $m_d$ is the mass of the textile material in the dry state under normal climatic conditions (T=20° C.±2° C. and RH=65%±2%).

If dyeing is carried out with a relative humidity of the fluid which is over 100%, there is free water in the system, which may cause rings to be formed in/on the textile material. There may even be a (polar) liquid film on the textile material, which makes transfer of the nonpolar dyestuff difficult.

Maintaining the relative humidity of the fluid in the range from 10 to 100% during the dyeing ensures that the textile material remains sufficiently moist and therefore is and remains sufficiently accessible for the uptake of the dyestuff. Furthermore, it is assumed that cotton with water forms a stronger nucleophilic reagent for fixation of the dyestuff than dry cotton.

Good fixation of the dyestuff is necessary if good washfastness and fastness to rubbing are to be obtained. For this purpose, the fixation is to take place by means of a nucleophilic reaction between the reactive groups of the dyestuff, on the one hand, and the fibre, on the other hand, for which reaction moisture is required and which reaction leads to the dyestuff being covalently bonded to the fibres of the textile material.

The way in which the relative humidity of the fluid is set and maintained in the range from 10–100% during the method is not critical. The possibilities include injection of water into the supercritical fluid, pretreatment of the textile material with water and extraction of water with the aid, for example, of molecular sieves or a condenser. The relative humidity can be measured using a capacitance meter.

DESCRIPTION OF THE PREFERRED EMBODIMENTS

The relative gas humidity is advantageously in the range from 50–100%, more preferably 60%, in particular is approximately 75%. It has been found that a relative humidity of the fluid of approximately 75% is advantageous for dyeing cotton and silk with a view to the dyeing and fixation. With a view to dyeing wool and viscose, the relative humidity of the fluid is advantageously in the range from 60–100%, although with a view to fixation a relative humidity of approximately 75% is once again preferred (T=115° C. and p=260 bar).

Very good fixation for silk and wool is achieved with the aid of the method according to the invention, with 95–99% of the dyestuff being covalently bonded.

To obtain good fixation of the fibre-reactive disperse dyestuff which is used in the method according to the invention to cellulose-containing textile materials, it is advantageous to modify the reactive groups of the cellulose, as described, for example, in the abovementioned publication DE-A1-44 22 707, the substrate being modified prior to dyeing. A more general description of the modification of cotton is given by R. B. M. Holweg et al., "Reactive cotton", 18th IFATCC Congress 1999, Copenhagen, Sep. 8–10, 1999, pp. 58–64. For this modification, so-called aminating agents are used, which contain amino groups which react with and are thus fixed to the cellulose fibres via a covalent bond. For use in $CO_2$, it is common to use aminating agents with primary and/or secondary amino groups, with which the reactive groups of the fibre-reactive disperse dyestuff can react and form a covalent bond. One example of an agent of this type is an aliphatic polyamine, available from Clariant, which gives secondary amino groups to the cellulose fibres. These aminating agents may also be small molecules, as described in U.S. Pat. No. 1,779,970.

It will be understood that, strictly speaking, it is not necessary for the relative humidity of the fluid to be maintained in the range from 10–100% for synthetic fibres, such as polyester and polyamide fibres, if present in the textile material, since these materials, on account of supercritical fluid being dissolved in the synthetic fibres, already have a relatively great accessibility for the dyestuff. It has been found that, when dyeing polyester using the method according to the invention, no unacceptable negative results are obtained for either dyeing or fixation. It is thus also possible for textile materials which are composed of a combination of natural fibres and synthetic fibres to be dyed simultaneously and under the same conditions, in particular with the same fluid and the same dyestuff.

For cellulose, the desired relative humidity of the fluid is advantageously set by subjecting the textile material to a moistening step for premoistening the textile material with an aqueous moistening agent prior to the dyeing. The aqueous moistening agent may, for example, be water, to which, if desired, additives are added.

The moistening step may, for example, be carried out using the padding method (foulard), in which the textile material is passed through a bath of the aqueous moistening agent and then the material is squeezed until the desired moisture content is reached.

The aqueous moistening agent may contain at least one auxiliary. In particular, the moistening agent may contain one or more agents which promote the accessibility of the fibres of the textile materials for the dyestuff, such as the preferred melamine, urea or thiodiethylene glycol.

Another auxiliary which can be considered for use in the moistening agent is a reaction-accelerating auxiliary for accelerating the reaction between the reactive disperse dyestuff and the textile material. Examples of these auxiliaries include, inter alia, pyridine or ammonium salts. These reaction accelerators often contain tertiary and quaternary amino groups. The abovementioned aminating agents may also be added to the moistening agent. Then, the textile material is dyed in accordance with the method according to the invention.

If desired, an agent for promoting the solubility of the fibre-reactive disperse dyestuff, such as acetone or ethanol, may be added to the supercritical fluid.

The dyeing conditions are selected on the basis of the textile material to be dyed. The temperature is usually in the range from 20–220° C., preferably 90–150° C. The pressure which is applied during dyeing should be at least sufficiently high for the fluid to be in the supercritical or almost critical state at the prevailing temperature. The pressure is usually in the range from $5\times10^6$–$5\times10^7$ Pa (50–500 bar), more preferably $2\times10^7$–$3\times10^7$ Pa (200–300 bar). As non-limiting examples, it is possible to mention a temperature of approximately 140° C. and a pressure of approximately $2.5\times10^7$ Pa (250 bar) for dyeing cotton, while for wool a temperature of approximately 110° and a pressure of approximately $2.5\times10^7$ Pa (250 bar) are preferred.

In addition to the padding method mentioned above, the moistening can also be carried out prior to the actual dyeing process, in which case the textile material is already in a dyeing vessel of the dyeing device used.

The moisture content can also be set during the dyeing itself, for example by injection of water or steam into the circulating fluid, to which, if desired, the necessary additives are added.

In this context, it should be pointed out that adding water as modifying agent in order to increase the polarity of the supercritical fluid for polar dyeing systems is described in DE-A-39 06 724, with the result that the solubility of the polar dyestuffs in the supercritical fluid is increased. However, in the method according to the present application the fibre-reactive disperse dyeing systems are apolar. Free water is present in a system of this type. By contrast, in the present invention the water has the function of ensuring the accessibility of the fibres for the dissolved dyestuff, so that the fibres are able to take up the dyestuff.

A dyeing device which is suitable for use in the method according to the invention is known in the specialist field and is described, for example, in an article entitled "Experience with the Uhde $CO_2$-dyeing plant on technical scale", Melliand International (3), 1998.

The reactive disperse dyestuffs which can be used in the method according to the invention may be selected from the dyestuffs which are mentioned, for example, in DE-A1-44 22 707, DE-A-20 08 811, U.S. Pat. Nos. 3,974,160, 5,498, 267, 4,969,951, CH-A-564 515 and Japanese patent publications JP-3-247 665, JP 92/059 347, JP 91/035 342, JP 91/032 585 and JP 91/032 587.

The present invention also relates to a device for dyeing textile material in a supercritical or almost critical fluid, comprising a pressure vessel for holding the textile material which is to be dyed and means for supplying the fluid to the pressure vessel, wherein the device is also provided with regulating means for regulating the relative humidity of the fluid. During use of the device according to the invention, the relative humidity of the fluid is regulated by measuring the actual relative humidity with suitable measuring means, for example with a capacitance meter, and, in the event of deviation from the desired value, either adding moisture or extracting moisture. For this purpose, the regulating means may comprise supply means for supplying moisture and/or means for extracting moisture to/from the supercritical fluid. The supply means may be directly connected to the pressure vessel but may also be connected to the supply means for the supercritical fluid. Supply means of this type comprise, for example, injection means for the injection of steam. A condenser and a bed of molecular sieve material are examples of means for extracting moisture from the supercritical fluid, which may be arranged, for example, in the circulation pipe network of the supercritical fluid.

The present application is explained below with reference to the following examples. In these examples, the dyeing efficiency (measure of the fixation) is determined by washing at 95° C. in accordance with the applicable ISO standard 105-C06, and determined with a boiling extraction with a mixture of water and acetone (volumetric ratio 4:1; t=0.5 h).

EXAMPLE 1 (D-III)

A rectangular piece of mercerized cotton weighing 21.5 g, with a natural moisture content of approx. 11% by weight, was premoistened with a mixture of 4.8% by weight aliphatic polyamine (Sandene) in water. Water was removed from the premoistened piece until it weighed 43.0 g. The piece was folded three times, so that it was divided into eight identical pieces, and was suspended at a height of approximately 25 cm in a cylindrical high-pressure vessel with a diameter of 12 cm and a height of 45 cm. A pulverulent orange reactive disperse dyestuff (available from Ciba Geigy) was placed in the bottom of the vessel, between two filter plates. The filter openings were smaller than the dimensions of the powder particles, so that the dyestuff was only able to flow through the filter openings and come into contact with the cloth in dissolved form. The vessel was sealed, after which $CO_2$ was pumped into the vessel with the aid of a feed pump. Once a pressure of 180 bar had been reached, a circulation pump was activated, so that the supercritical fluid circulated through the vessel at a flowrate of 110l/h. When a pressure of 210 bar was reached, the supply of $CO_2$ was stopped. The circulation of $CO_2$ was continued for two hours. The vessel was heated on the outside, with the result that the pressure rose to 284 bar and the temperature rose from 99° C. to 116° C. The mean pressure and temperature were 270 bar and 108° C. The mean relative humidity of the fluid was 58%, while the cotton had a moisture content of 8.8% by weight. The circulating $CO_2$ was first brought into contact with the dyestuff powder, so that the $CO_2$ was laden with dyestuff, and was then brought into contact with the suspended piece of cotton, to which the dyestuff was transferred. After two hours, the circulation pump was stopped and the $CO_2$ removed. The piece was very orange and evenly dyed. A section of the piece was then subjected to an extraction test using a mixture of acetone and water at the boiling point of this mixture. After the end of the extraction, 80% of the dyestuff was found still to be on the piece. Another section was subjected to a washing test at 95° C. Once it had finished, 94% of the dyestuff was found still to be present on the piece. The results of these tests indicate a very good fixation of the dyestuff.

When carrying out similar tests, in which cotton was wetted with water which contained an aliphatic polyamine as aminating agent and melamine as auxiliary, and was then dyed with the reactive disperse dyestuff at a mean relative humidity of the fluid of 70%, a mean pressure of 259 bar and a mean temperature of 112° C., a degree of fixation of 78% was achieved (test D-XI), but with a deeper dyeing than in Example 1.

An improvement to the degree of fixation was achieved when the cotton, prior to dyeing, was treated with the aliphatic polyamine in caustic soda solution at 50° C. and then, after the unfixed polyamine had been rinsed out, it is moistened with 1.3% by weight melamine in water in accordance with Example 2 below.

EXAMPLE 2 (D-X)

A rectangular piece of mercerized cotton weighing 21.5 g was premoistened with a mixture of 9.1% by weight aliphatic polyamine in NaOH at 50° C. The piece of cotton was then placed in a bath comprising 98.7% by weight water and 1.3% by weight melamine. Water was then removed from the piece of cotton which had been pretreated in this way, until the weight was 43.6 g. This cloth was suspended in the middle of the cylindrical vessel used in EXAMPLE 1, and the further procedure described in that example was repeated. The mean pressure and temperature were 267 bar and 113° C. The mean relative humidity of the fluid was 54%. The moisture content of the cotton was 7.9% by weight. The piece was very orange and evenly dyed. A section of the piece was then subjected to an extraction test using a mixture of acetone and water at the boiling point of this mixture. After the end of the extraction, 92% of the dyestuff was found still to be present on the piece. Another section was subjected to a washing test at 95° C. After the end of this test, 96% of the dyestuff was found still to be present on the piece. The results of these tests indicate very good fixation (mean 94%) of the dyestuff.

During this test, small pieces of viscose which had likewise been treated with the aliphatic polyamine, silk, wool and polyester were also dyed (cf. also EXAMPLE 3), and mean fixation values of 93, 94, 99 and 93%, respectively, were obtained.

When this test is repeated at a low relative gas humidity of 5% and T=110° C. and p=263 bar (test D-XIII), the pretreated cotton is only very slightly dyed, with a degree of fixation of 36%. The piece also processed at the same time, of silk is scarcely dyed at all, the piece of wool is very slightly dyed with a degree of fixation of 81% and the polyester is well dyed with a degree of fixation of 91%.

EXAMPLE 3 (D-I)

A rectangular piece of dry, mercerized cotton weighing 24.6 g was moistened with a mixture of 98.8% by weight water and 1.2% by weight melamine. In addition, a rectangular piece of silk weighing 0.4 g, a piece of knitted wool weighing 0.3 g and a piece of polyester weighing 0.3 g were treated with the above mixture of water and melamine. These three pieces were placed in the pretreated piece of cotton. After removal of water, the weight of the piece of cotton was 47.3 g. Then, the complete set was dyed in the same way as described in EXAMPLE 1. The mean pressure was 272 bar. The mean temperature was 112° C. The mean relative humidity of the fluid was 74%, while the cotton had a moisture percentage of 12.3% by weight. After the dyeing process had finished, sections of the pieces of textile were extracted using a mixture of acetone and water at the boiling point of this mixture. In this case, it was found that, after extraction, 95% remained on the silk, 97% remained on the wool, 97% remained on the polyester and 34% remained on the cotton.

What is claimed is:

1. Method for dyeing textile material, comprising the step of applying one or more fibre-reactive disperse dyestuffs to the textile material in a supercritical or almost critical fluid, which textile material is selected from the group consisting of silk, wool and cellulose, combinations thereof and combinations of one or more thereof with synthetic fibres, and maintaining the relative humidity of the fluid in the range from 10–100% during dyeing.

2. Method according to claim 1, wherein the relative humidity of the fluid is maintained in the range of 50–100% during dyeing.

3. Method according to claim 2, wherein the relative humidity of the fluid is maintained at approximately 75% during dying.

4. Method according to claim 1, wherein the supercritical fluid is selected from $CO_2$, $N_2O$, ethane, propane or mixtures thereof.

5. Method according to claim 1, wherein the relative humidity of the fluid is regulated by adding an aqueous moistening agent to the supercritical fluid.

6. Method according to claim 1, wherein the relative humidity of the fluid is regulated by extracting moisture from the supercritical fluid.

7. Method according to claim 1, wherein prior to dyeing a moistening step for premoistening the textile material is carried out using an aqueous moistening agent.

8. Method according to claim 5, wherein the aqueous moistening agent comprises an auxiliary for increasing the accessibility of the fibres for the dyestuff.

9. Method according to claim 8, wherein the auxiliary is selected from melamine, urea or thiodiethylene glycol.

10. Method according to claim 5, wherein the aqueous moistening agent comprises a reaction-promoting auxiliary for promoting the reaction between the reactive disperse dyestuff and the textile material.

11. Method according to claim 10, wherein the reaction-promoting auxiliary is selected from pyridine and ammonium salts.

12. Method according to claim 5, wherein the aqueous moistening agent comprises an aminating agent.

13. Method according to claim 1, wherein the dyeing is carried out at a temperature in the range from 20–220° C.

14. Method according to claim 1, wherein the dyeing is carried out at a pressure in the range from $5\times10^6$–$5\times10^7$ Pa (50–500 bar).

15. Method according to claim 1, wherein prior to dyeing a moistening step for pre-moistening the textile material is carried out using water as an aqueous moistening agent.

16. Method according to claim 5, wherein the aqueous moistening agent comprises an auxiliary for increasing the accessibility of the fibres for the dyestuff, which auxiliary is selected from melamine, urea or thiodiethylene glycol.

17. Method according to claim 1, wherein the dyeing is carried out at a temperature in the range form 90–150° C.

18. Method according to claim 1, wherein the dyeing is carried out at a pressure in the range from $2\times10^7$–$3\times10^7$ Pa (200–300bar).

* * * * *

UNITED STATES PATENT AND TRADEMARK OFFICE

CERTIFICATE OF CORRECTION

PATENT NO. : 6,620,211 B2
DATED : September 16, 2003
INVENTOR(S) : Veugelers et al.

It is certified that error appears in the above-identified patent and that said Letters Patent is hereby corrected as shown below:

Column 2,
Line 2, please delete "...textile material Into…" and insert -- textile material into --.

Column 5,
Line 47, please delete "...approximately 110°and a…" and insert -- approximately 110° C and a --.

Column 6,
Line 63, please delete "...1101/h. when a…" and insert -- 110 1/h. when a --.

Column 9,
Line 6, please delete "...range form 90-150° C." and insert -- range from 90-150°C. --

Signed and Sealed this

Eighteenth Day of November, 2003

JAMES E. ROGAN
*Director of the United States Patent and Trademark Office*